US005722307A

United States Patent [19]

Chen

[11] Patent Number: 5,722,307

[45] Date of Patent: Mar. 3, 1998

[54] SCREW DRIVER HAVING A RETRACTABLE AND ROTATABLE HANDLE

[76] Inventor: Chun Chiung Chen, No. 45, Lane 25, Kuo Chung 1st Road, Da Li City, Taichung Hsien, Taiwan

[21] Appl. No.: 802,866

[22] Filed: Feb. 19, 1997

[51] Int. Cl.[6] ..... B25B 13/00

[52] U.S. Cl. ..... 81/58.3; 81/177.2; 81/177.5; 81/177.6; 81/58.1

[58] Field of Search ..... 81/58.3, 58.1, 81/73, 177.2, 177.5, 35, 177.6, 28

[56] References Cited

U.S. PATENT DOCUMENTS

| | | | |
|---|---|---|---|
| 1,175,902 | 3/1916 | Peterson | 81/177.5 |
| 2,572,444 | 10/1951 | Carden | 81/177.2 |
| 2,672,066 | 3/1954 | Sandrock et al. | 81/58.1 |
| 2,679,272 | 5/1954 | Giannone | 81/58.3 |
| 3,272,246 | 9/1966 | Bohnet | 81/58.3 |

*Primary Examiner*—James G. Smith
*Assistant Examiner*—Lee Wilson
*Attorney, Agent, or Firm*—Charles E. Baxley, Esq.

[57] ABSTRACT

A screw driver includes a rod slidably and rotatably received in a hand grip and having one end for engaging with a tool bit. A handle has one end pivotally coupled to the rod for allowing the handle to rotate to a position perpendicular to the rod and for allowing the handle to apply a great torque to the rod and for allowing the tool bit and the rod to be easily operated. The handle includes a pole pivotally coupled to the rod and a sleeve engaged on the pole. The sleeve has an annular flange for engaging with an enlarged head of the pole and for limiting a relative movement between the pole and the sleeve.

4 Claims, 6 Drawing Sheets

SCREW DRIVER HAVING A RETRACTABLE AND ROTATABLE HANDLE

BACKGROUND OF THE INVENTION

1. Field of the Invention

The present invention relates to a screw driver, and more particularly to a screw driver having a rotating handle for actuating the screw driver.

2. Description of the Prior Art

Typical screw drivers comprise a handle and a driving rod extended from the handle. However, the handle and the driving rod are aligned and are arranged in a line such that the handle may not apply a large torque to the driving rod and such that the driving rod may not be easily rotated with great force.

The present invention has arisen to mitigate and/or obviate the afore-described disadvantages of the conventional screw drivers.

SUMMARY OF THE INVENTION

The primary objective of the present invention is to provide a screw driver which includes a pole for applying a large torque to the driving rod and for facilitating the operation of the screw driver.

In accordance with one aspect of the invention, there is provided a screw driver comprising a hand grip including a bore, a rod slidably and rotatably received in the hand grip. The rod includes a first end for engaging with a tool bit and includes a second end. A handle includes a first end pivotally coupled to the second end for allowing the handle to rotate to a position perpendicular to the rod and for allowing the handle to apply a great torque to the rod, such that the tool bit and the rod may be easily rotated by the handle with a great force.

The hand grip includes a first end having a block secured to the hand grip, the block includes at least one projection, the rod includes an extension, the screw driver further includes a rotary member slidably engaged on the extension of the rod and rotated in concert with the rod, the rotary member includes at least one notch for engaging with the projection of the block and for allowing the rod and the rotary member to be rotated by the block and the hand grip.

The rod includes two annular grooves, the block includes a slot and a key engaged in the slot, the key includes an aperture for engaging with the rod, the block includes means for biasing the key outward of the block and for biasing the key to engage with the annular grooves and for allowing the key to position the rod to the block.

The block includes a second end having a flange extended radially inward for engaging with the rotary ember and for preventing the rotary member and the rod from disengaging from the hand grip.

The handle includes a pole having a first end pivotally coupled to the rod and having a second end, the pole includes an enlarged head formed on the second end, the handle further includes a sleeve engaged on the pole, the sleeve includes a first end having an annular flange for engaging with the head of the pole and for limiting a relative movement between the pole and the sleeve.

The sleeve includes a second end, and the handle includes a knob pivotally coupled to the second end of the sleeve for rotating the handle about the rod.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
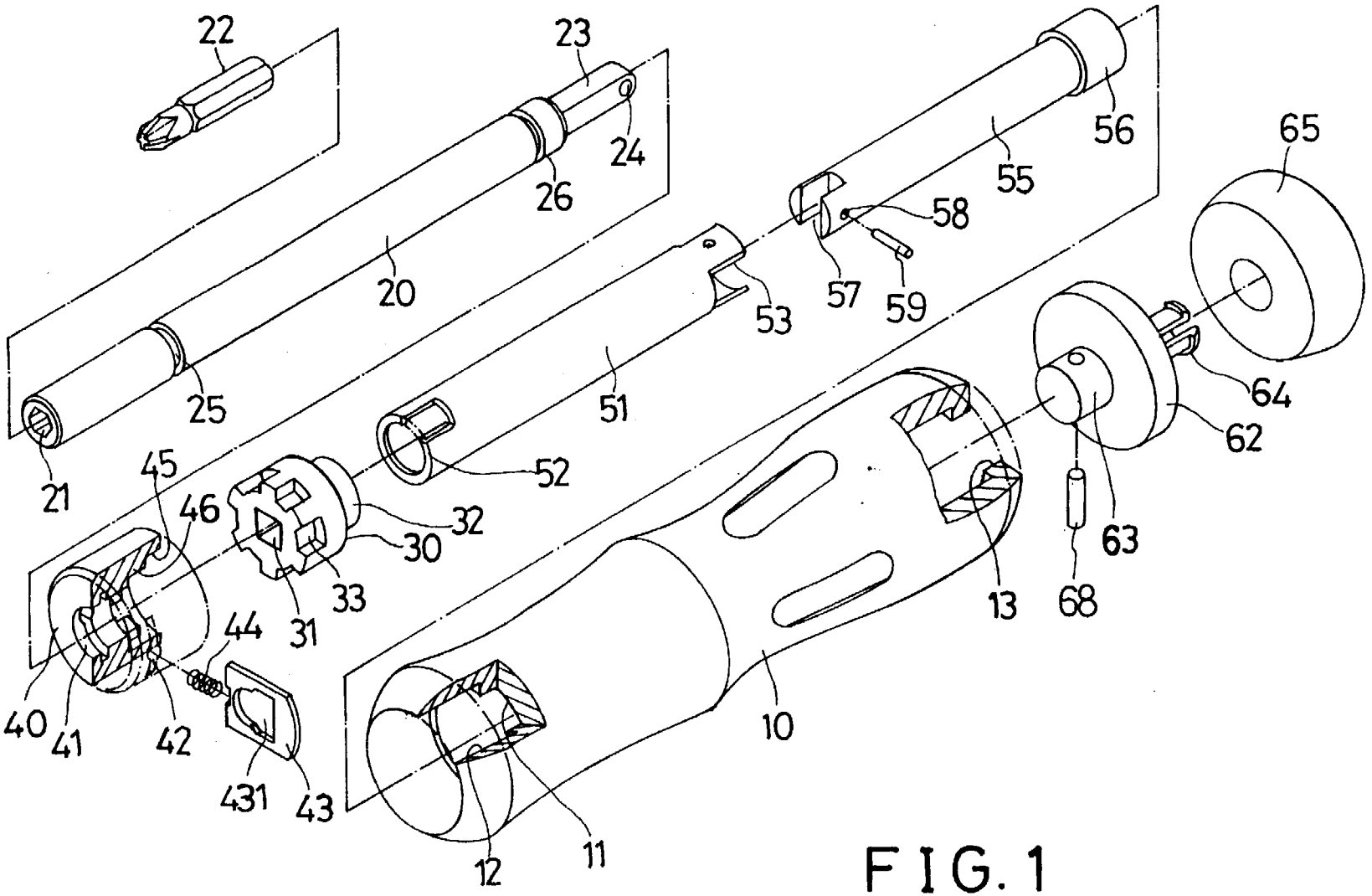
FIG. 1 is an exploded view of a screw driver in accordance with the present invention.
Figure 2:
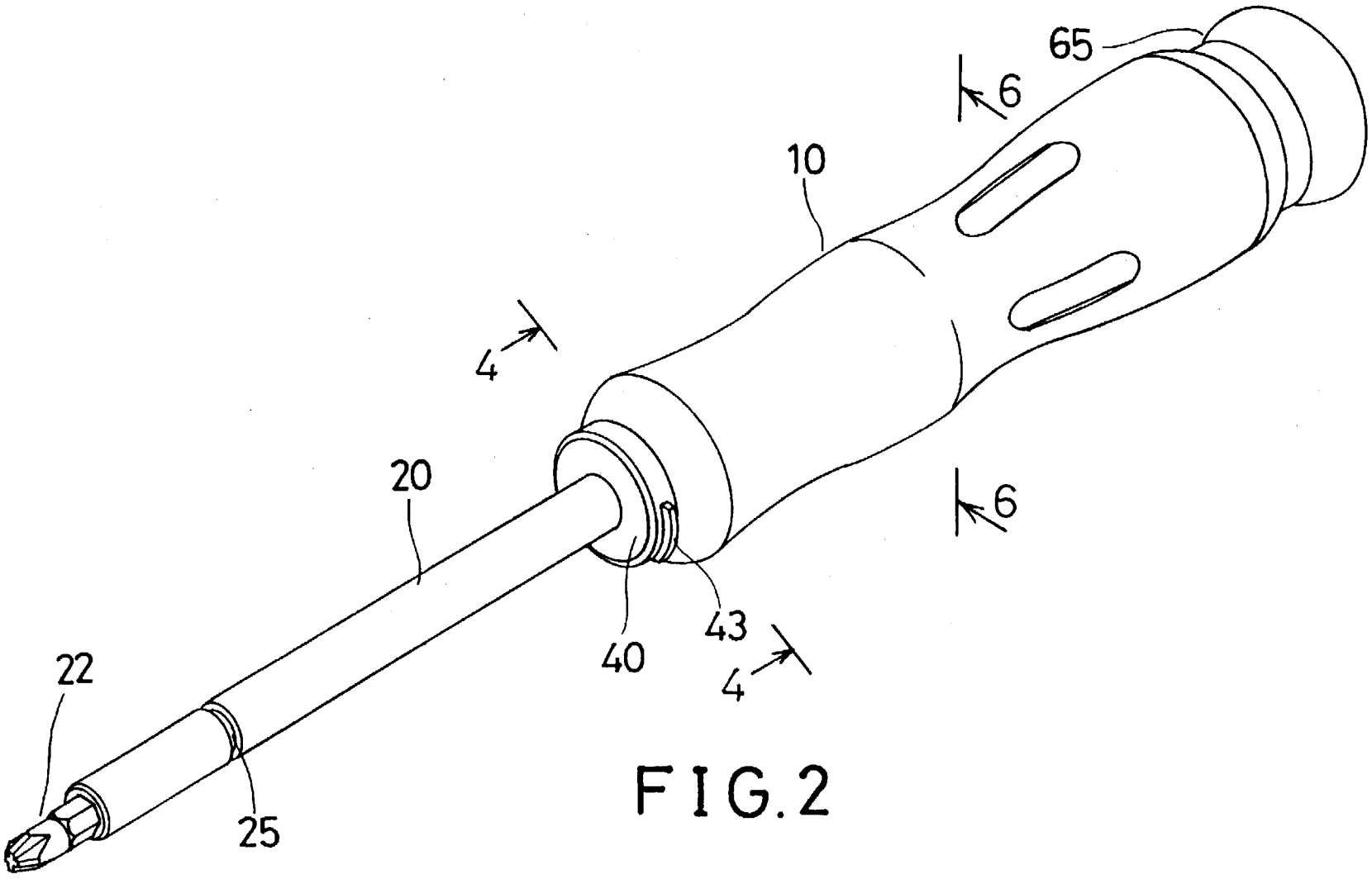
FIG. 2 is a perspective view of the screw driver.
Figure 3:
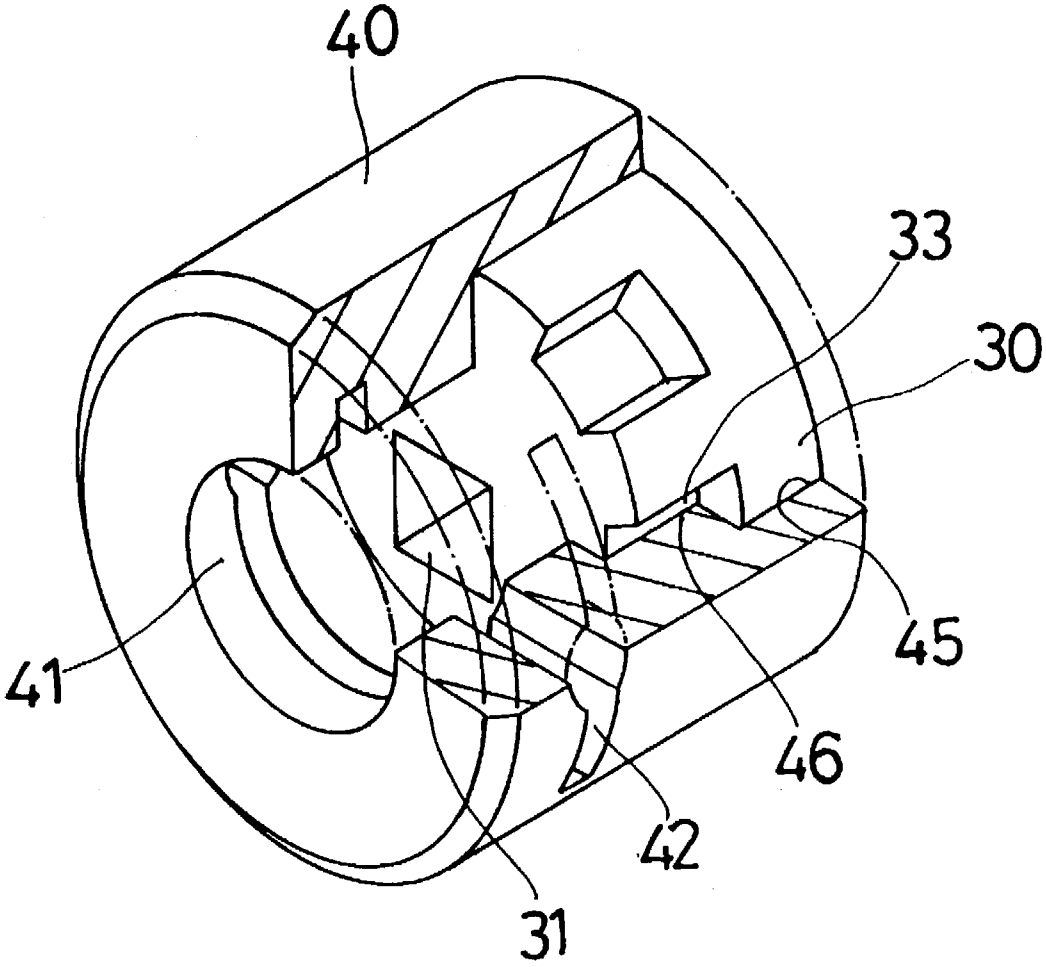
FIG. 3 is a partial perspective view of the screw driver.
Figure 5:
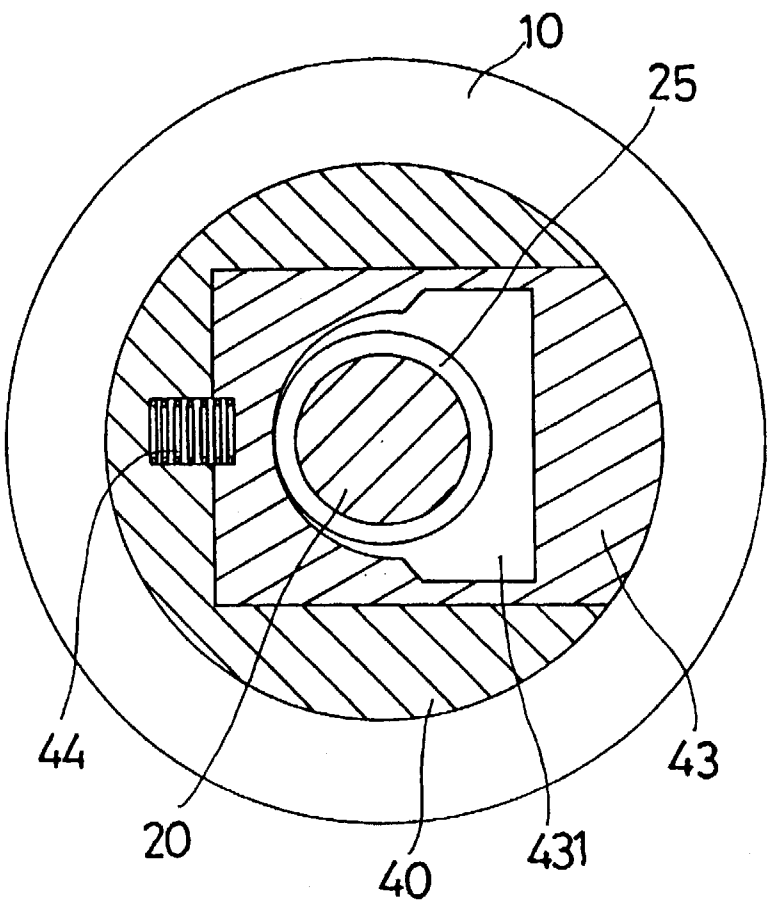
FIGS. 4 and 5 are cross sectional views taken along lines 4—4 of FIG. 2.
Figure 4:
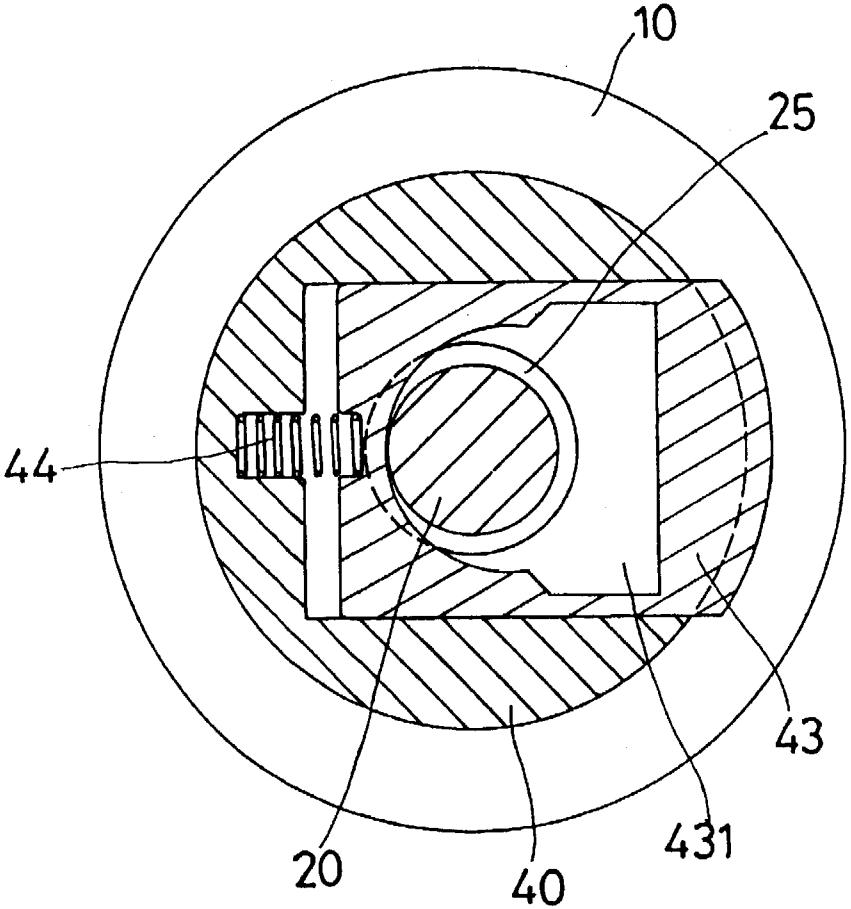

Referring to the drawings, and initially to FIGS. 1 to 3, a screw driver in accordance with the present invention comprises a hand grip 10 including a bore 11 having a front portion 12 for fixing a block 40 and including a flange 13 extended radially inward of the bore 11. The block 40 is fixed in the front portion 12 of the hand grip 10 by such as welding process or by key engagement and includes an orifice 41 for engaging with a rod 20. The block 40 includes an opening 45 for rotatably engaging with a rotary member 30 and includes one or more projections 46. The block 40 includes a slot 42 for engaging with a key 43. A spring 44 may bias the key 43 outward of the block 40. The key 43 includes an aperture 43 for engaging with the rod 20 (FIGS. 4, 5). The rod 20 includes two grooves 25, 26 for engaging with the key 43 (FIGS. 4, 5) which may position the rod to the hand grip 10. The rod 20 includes a hole 21 for engaging with a tool bit 22 and includes an extension 23 having a hole 24.

Figure 6:
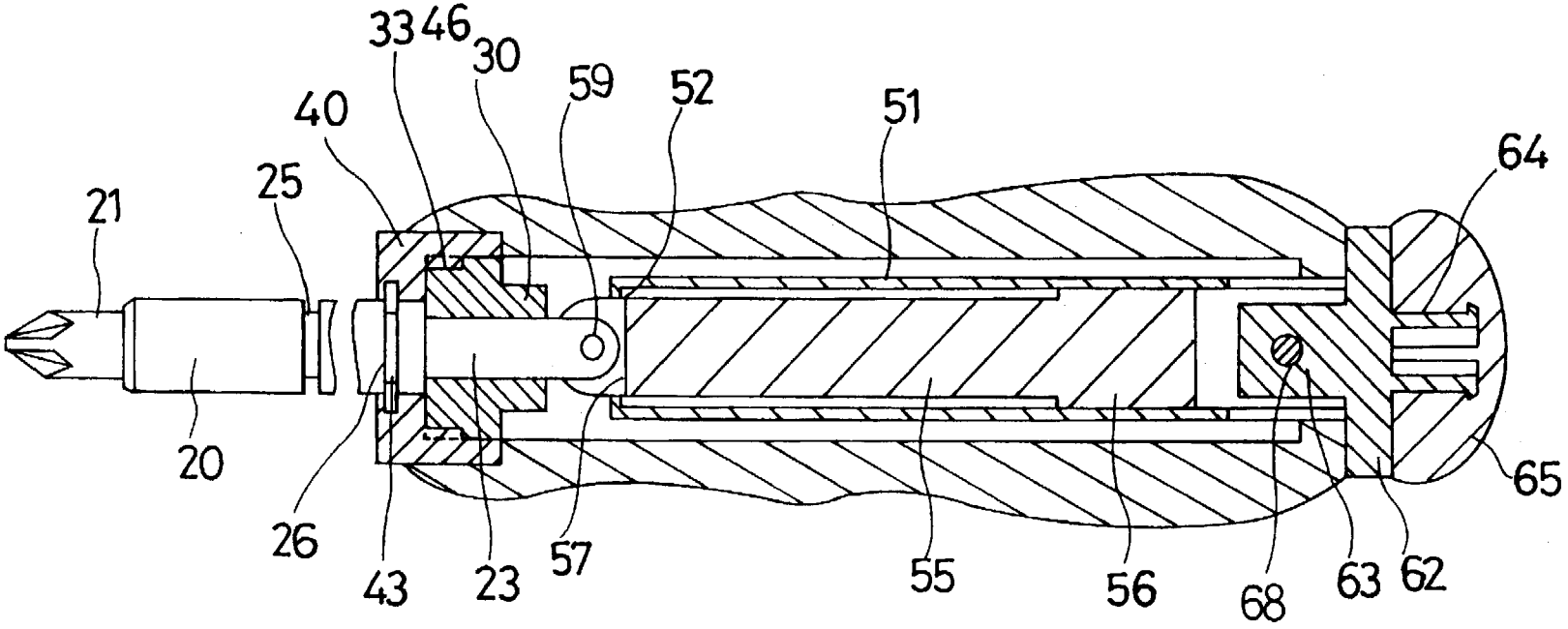
FIGS. 6 and 7 are cross sectional views taken along lines 6—6 of FIG. 2.
Figure 7:
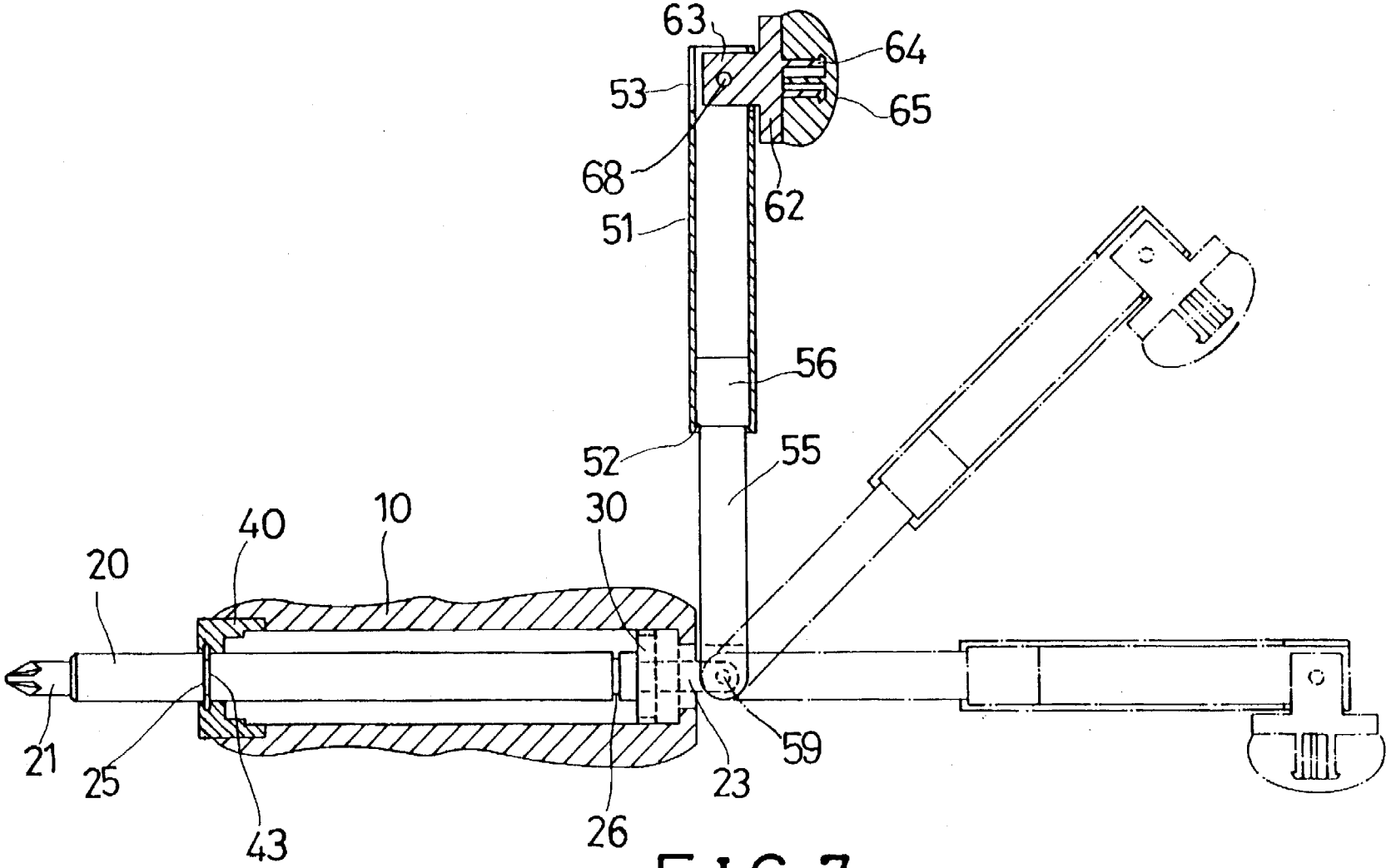

The rotary member 30 includes a square hole 31 for engaging with the extension 23 and for allowing the rod 20 to be rotated in concert with the rotary member 30 which includes a number of notches 33 for engaging with the projections 46 (FIG. 3) and for allowing the rotary member 30 to be rotated in concert with the block 40 and the hand grip 10. The rotary member 30 includes a stud 32 for engaging through the flange 13 of the hand grip 10. The rotary member 30 may engage with the flange 13 (FIG. 7) for preventing the rod 20 from moving outward of the hand grip 10. A pole 55 includes a cavity 57 for engaging with the extension 23 of the rod 20. A pin 59 is engaged through the hole 58 of the pole 5 and through the hole 24 of the rod 20 for pivotally coupling the pole 55 to the rod 20. The pole 55 includes an enlarged head 56. A sleeve 51 is engaged on the pole 55 and includes an annular flange 52 extended radially inward for engaging with the head 56 and for limiting the relative movement of the pole 55 relative to the sleeve 51 (FIGS. 6, 7). The sleeve 51 includes an opening 53 for engaging with a stud 63 of a disc 62 and a pin 68 is engaged through the stud 63 and the sleeve 51 for pivotally coupling the disc 62 to the sleeve 51. The disc 62 includes a hub 64 for rotatably supporting a knob 65. The pole 55 and the sleeve 51 form a handle for rotating the rod 20.

In operation, as shown in FIG. 6, when the pole 55 and the sleeve 51 are engaged in the hand grip 10, the notches 33 of the rotary member 30 are engaged with the projections 46 of the block 40 which is fixed to the hand grip 10 such that the rod 20 and the rotary member 30 may be rotated by the hand grip 10. As shown in FIG. 7, when the sleeve 51 and the pole 55 are pulled outward of the hand grip 10, the pole 55 and the sleeve 51 may be rotated to a position perpendicular to the rod 20 such that the rotation of the pole 55 may apply a great torque to the rod 20 and such that the rod 20 may be easily rotated.

Accordingly, the screw driver in accordance with the present invention includes a pole for applying a large torque to the driving rod and for facilitating the operation of the screw driver.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A screw driver comprising:

a hand grip including a bore and including a first end having a block secured to said hand grip, said block including at least one projection, a rod slidably and rotatably received in said hand grip and including a first end for engaging with a tool bit and including a second end, said rod including an extension, a rotary member slidably engaged on said extension of said rod and rotated in concert with said rod, said rotary member including at lest one notch for engaging with said projection of said block and for allowing said rod and said rotary member to be rotated by said block and said hand grip, a handle including a first end pivotally coupled to said second end of said rod for allowing said handle to rotate to a position perpendicular to said rod and for allowing said handle to apply a great torque to said rod, and said rod including two annular grooves, said block including a slot and a key engaged in said slot, said key including an aperture for engaging with said rod, said block including means for biasing said key outward of said block and for biasing said key to engage with said annular grooves and for allowing said key to position said rod to said block.

2. A screw driver according to claim 1, wherein said hand grip includes a second end having a flange extended radially inward for engaging with said rotary member and for preventing said rotary member and said rod from disengaging from said hand grip.

3. A screw driver comprising:

a hand grip including a bore, a rod slidably and rotatably received in said hand grip, said rod including a first end for engaging with a tool bit and including a second end, a handle including a first end pivotally coupled to said second end of said rod for allowing said handle to rotate to a position perpendicular to said rod and for allowing said handle to apply a great torque to said rod, and said handle including a pole having a first end pivotally coupled to said rod and having a second end, said pole including an enlarged head formed on said second end, said handle further including a sleeve engaged on said pole, said sleeve including a first end having an annular flange for engaging with said head of said pole and for limiting a relative movement between said pole and said sleeve.

4. A screw driver according to claim 3, wherein said sleeve includes a second end, and said handle includes a knob pivotally coupled to said second end of said sleeve for rotating said handle about said rod.

* * * * *